US005297299A

United States Patent [19]

Wilson

[11] Patent Number: 5,297,299

[45] Date of Patent: Mar. 29, 1994

[54] DRAIN HAIR NET

[76] Inventor: Mary A. Wilson, Box 213, Palmetto, Fla. 34221

[21] Appl. No.: 961,878

[22] Filed: Oct. 16, 1992

[51] Int. Cl.[5] ..... E03C 1/264

[52] U.S. Cl. ..... 4/290; 4/292; 210/232; 210/463; 210/479

[58] Field of Search ..... 4/290, 292, 288, 289, 4/291; 210/164, 232, 463, 479, 499

[56] References Cited

U.S. PATENT DOCUMENTS

| | | | |
|---|---|---|---|
| 919,431 | 4/1909 | Horne | 4/290 X |
| 1,313,153 | 8/1919 | Zboyan | 4/291 |
| 1,413,892 | 4/1922 | Bergholz | 210/479 |
| 1,467,772 | 9/1923 | Appelhoff | 4/291 |
| 3,742,524 | 7/1973 | Ballentine | 4/292 X |
| 4,443,897 | 4/1984 | Austin | 4/291 |
| 4,671,976 | 6/1987 | Vidal | 4/292 X |

FOREIGN PATENT DOCUMENTS

| | | | |
|---|---|---|---|
| 0020577 | of 1911 | United Kingdom | 210/463 |
| 0705094 | 3/1954 | United Kingdom | 4/292 |

*Primary Examiner*—Robert M. Fetsuga

[57] ABSTRACT

A plastic device using nylon thread mesh material as a trapping element to prevent clogging of traps and drain lines caused by loose hair or other objects dropped in or washed down the drain opening. The device includes an annular flange having a depending collar which fits into a section of tubing sandwiching the mesh material between the flange and tubing. The tubing is sized to fit into the drain opening and the mesh material is sized to extend beyond the edge of the flange to cover any peripheral opening between the tubing and drain opening and to provide a tab for easy removal of the device.

3 Claims, 1 Drawing Sheet

DRAIN HAIR NET

BACKGROUND OF INVENTION

1. Field of Invention

1. This invention is a new improvement to an old problem of trap and drain cloggings caused by hair and other objects dropped and/or washed into drain openings.

This new improvement is with the use of plastic materials used in conjunction with domestic nylon thread mesh material.

2. This new invention is maintained in the drain opening by the downward flow of water.

3. The nylon thread in the mesh material, having a slick texture, lends itself to a quick and easy removal of hair.

4. Although newer drain openings are equipped with pop-up type stoppers, in many cases these may be altered or removed to accomodate this new device.

2. Description of Prior Art

1. Prior inventions illustrate various attachments for holding and securing these devices in drain openings.

2. A prior invention illustrates the use of tightly meshed screen metal wire as a hair and drain strainer.

3. A prior invention illustrates the use of netting material having hooked spikes and bristles, or the like, attached thereto for a gripping and tangling action for catching hair.

SUMMARY

The vast majority of trap and drain cloggings occur in household settings, the primary cause being loose hair strands from shampooing or the combing of hair over basins or the like. Other objects, such as tooth paste caps, contact lens, jewelry and other paraphernalia necessitate the removal of traps in an attempt to recover these objects and clear the water flow.

This new invention could prevent, or certainly limit, the storing and use of caustic chemical solvents, snaking equipment or, as a last resort, expensive plumbing costs.

This invention, compared to plumbing costs, is inexpensive, and easy to remove from drain openings, making cleaning and removal of trapped hair a quick process.

DESCRIPTION OF THE PREFERRED EMBODIMENT

Figure 3:
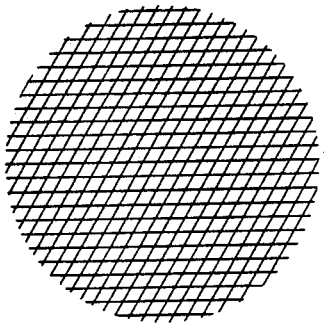
FIG. 3 illustrates a circle of netting material.
Figure 1:
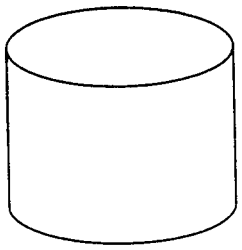
FIG. 1 illustrates an open-ended section of plastic tubing.
Figure 2:
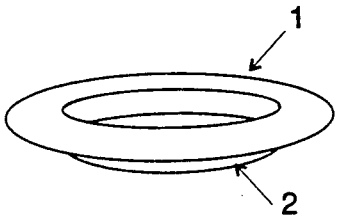
FIG. 2 illustrates a plastic washer.
Figure 4:
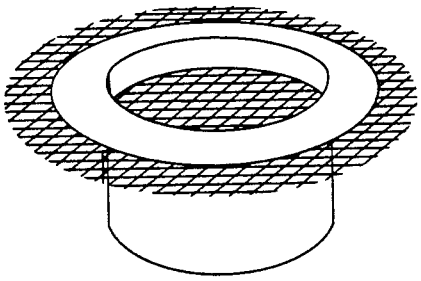
FIG. 4 illustrates the elements of FIGS. 1–3 in an assembled configuration.

1. An open-ended section of plastic tubing as shown in FIG. 1 is sized to fit detachably in a drain opening of a sink or tub/shower. A plastic flange member as shown in FIG. 2 includes an annular top portion 1 having a width of about ¼" and a depending collar 2 having a height of about ¼". A flexible woven nylon thread mesh netting material as shown in FIG. 3 is disposed between the plastic tubing and flange member. The collar 2 of the flange member is pressed into the plastic tubing until the netting is sandwiched between the undersurface of the top portion 1 and the top end of the tubing. The assembled elements create about a ¼" deep well. As shown in FIG. 4, the diameter of the netting is such to allow it to extend circumferentially about ¼" beyond the top portion 1 to cover any peripheral opening between the drain opening and the plastic tubing when the tubing is inserted in the opening and to provide a tab for easy removal of the assembly.

2. The flange member is constructed of rigid plastic to facilitate assembly.

3. The woven nylon thread mesh material is used for its durability, resistance to fraying and slick texture. The mesh allows fast flow of soapy water through the drain and quick and easy removal of trapped hair.

4. The assembled elements may be separated for replacement of the netting as usage warrants or for a thorough cleaning.

I claim:

1. A drain hair net for use with conventional drain openings comprising:

a cylindrical member having top and bottom ends and an outer diameter sized to fit detachably into the drain opening;

a circular section of flexible netting having a diameter larger than said outer diameter of said cylindrical member; and a flange member including an annular disc-shaped top portion having an undersurface and a cylindrical collar having an inner diameter substantially equal to the inner diameter of said top portion, said collar being coaxial with and depending from said top portion, said collar further having an outer diameter substantially equal to the inner diameter of said cylindrical member, wherein said netting is frictionally retained between said undersurface of said top portion and said top end of said cylindrical portion with said collar fully inserted into said cylindrical member such that said netting is engagingly sandwiched between said top end and said undersurface, and wherein said netting extends circumferentially beyond the outer circumferential edge of said top portion when said collar is fully inserted into said cylindrical member.

2. The drain hair net of claim 1, wherein said cylindrical member and said flange member are constructed of plastic.

3. The drain hair net of claim 1, wherein said netting is constructed of nylon thread mesh material.

* * * * *